US005624540A

United States Patent [19]

Jörgens

[11] Patent Number: 5,624,540

[45] Date of Patent: Apr. 29, 1997

[54] DEVICE FOR THE ELECTROPHORETIC COATING OF THE INTERNAL SURFACE OF HOLLOW BODIES

[75] Inventor: Klaus Jörgens, Wuppertal, Germany

[73] Assignee: Enal AG, Switzerland

[21] Appl. No.: 586,737

[22] PCT Filed: Jul. 23, 1994

[86] PCT No.: PCT/EP94/02443

§ 371 Date: Jan. 30, 1996

§ 102(e) Date: Jan. 30, 1996

[87] PCT Pub. No.: WO95/04170

PCT Pub. Date: Feb. 9, 1995

[30] Foreign Application Priority Data

Jul. 30, 1993 [DE] Germany ..... 43 25 631.7

[51] Int. Cl.[6] ..... C25D 13/14; C25D 13/12

[52] U.S. Cl. ..... 204/625; 204/479

[58] Field of Search ..... 204/625, 623, 204/479

[56] References Cited

U.S. PATENT DOCUMENTS

| | | | |
|---|---|---|---|
| 3,922,213 | 11/1975 | Smith et al. | 204/625 X |
| 4,094,760 | 6/1978 | Smith et al. | 204/479 |
| 4,246,088 | 1/1981 | Murphy et al. | 204/479 X |
| 4,515,677 | 5/1985 | Heathcoat et al. | 204/625 |
| 4,544,475 | 10/1985 | Heffner et al. | 204/625 |
| 4,676,881 | 6/1987 | Davidson | 204/625 X |
| 4,883,578 | 11/1989 | Jowitt et al. | 204/625 X |
| 5,435,899 | 7/1995 | Gimenez et al. | 204/625 X |

*Primary Examiner*—Donald R. Valentine
*Assistant Examiner*—John S. Starsiak, Jr.
*Attorney, Agent, or Firm*—Ostrolenk, Faber, Gerb & Soffen, LLP

[57] ABSTRACT

Device for the electrophoretic coating of the internal surface of electrically conductive hollow bodies, in particular of packaging cans, having at least one mount, forming the anode or cathode, for at least one hollow body with the opening pointing downward, at least one nozzle, which can move axially in relation to the hollow body as far as the opening, for a water-soluble surface coating agent, which produces the connection to a cathode or anode, as liquid electrolyte of an electrically insulating seal, for the nozzle in the opening in the hollow body, and at least one return flow passage in the region between the nozzle and the internal edge of the opening in the hollow body.

13 Claims, 1 Drawing Sheet

DEVICE FOR THE ELECTROPHORETIC COATING OF THE INTERNAL SURFACE OF HOLLOW BODIES

BACKGROUND OF THE INVENTION

The invention relates to a device for the electrophoretic coating of the internal surface of electrically conductive hollow bodies which have an opening, in particular of packaging cans.

In the immersion method known from the European Patent Application 0 118 756, the hollow bodies are led in one continuous operation through an electrophoretic immersion coating bath in such a way that they are quickly and completely flooded with immersion bath fluid so that in the immersion bath they can be electrophoretically coated with a wet film. After sufficient coating time, the hollow bodies are lifted out of the immersion bath again and the immersion bath fluid located in them is poured out. After this, the hollow bodies coated in this way are fed mutually spaced from one another to a drying oven and dried therein, after which they can be printed on or labeled.

In this immersion method, the hollow bodies can only be electrophoretically coated on the outside and inside in a uniform way and they must be led into the electrophoretic coating bath in such a way that they are immersed with the opening pointing upward in order to be flooded and coated quickly and completely, after which they are lifted out of the immersion bath and have to be turned with the opening pointing downward so that the immersion bath fluid can run off. The result of this is that both the internal surface and the external surface must basically be coated with the same coating agent, which is not always required. Furthermore, a complex mechanism for immersing, lifting out and turning the hollow bodies has to be provided.

In the method described in the European Patent Application 0 431 711 a complex mechanism for immersing and lifting out the hollow bodies in an immersion bath is in fact not necessary since the hollow bodies are pushed with the opening pointing downward by means of an electrically conductive grille, the surface coating agent being rinsed, in jets which rise from below, in or over the hollow bodies through the free intermediate spaces between the grille bars or grating bars and at the same time covering the entire internal and external surface of the hollow bodies with an uninterrupted coating. In this process, the rising jet forms an uninterrupted conductive connection from an anode or cathode in a collection basin to the surface, forming the cathode or anode, of the hollow bodies. However, even with this method both the internal surface and the external surface are coated with the same electrophoretic surface coating agent.

In contrast, in the German Offenlegungsschrift 32 20 310 a method and a device for the simultaneous electrophoretic coating of the internal and external surfaces of a hollow body are described, with which method and device it is possible to coat the internal and external surfaces differently and with different surface coating agents. For this purpose, the hollow body is enclosed, with the opening turned downward, in a housing and a nozzle device is introduced into its interior, two separate through-passages being produced between the housing and container on the one hand and the container and nozzle device on the other, which through-passages are each provided with an inlet and an outlet so that they can be quickly filled with the electrophoretic coating material and the latter can be quickly discharged from them again. In this process, the coating material floods over the internal and external surfaces of the container and, owing to an electrical potential which is applied between the housing and container on the one hand and container and nozzle device on the other, is deposited on the surfaces of the hollow body. Two separate through-passages, each with a separate inlet and outlet, are provided for the coating material so that the internal and external surfaces of the container can be simultaneously coated with different coating materials and even with different thicknesses of coating.

A disadvantage with this device is that it is of complicated design since it is principally designed for the simultaneous coating of the external and internal surface of the hollow body. Furthermore, the movable nozzle must be introduced as far as the base of the hollow body so that the movements to be performed for each hollow body give rise to a considerable waste of time and it is not possible to achieve coating quickly, in particular of packaging cans.

SUMMARY OF THE INVENTION

Since the requirements to be met by the external coating of packaging cans, and also by other hollow bodies, are frequently less stringent than those to be met by the internal coating, and the electrophoretic coating is then in principle only required for the internal surface, there is a need for a device for coating only the internal surface of hollow bodies, in particular packaging cans, so that the invention is based on the object of providing a device for the electrophoretic coating of only the internal surface of hollow bodies, in particular packaging cans, which is of simple design and permits a large number of hollow bodies to be coated per unit time.

Taking this defined object as a starting point, a device is proposed for the electrophoretic coating of the internal surface of electrically conductive hollow bodies which have an opening, in particular of packaging cans. The which device according to the invention, has at least one mount, which forms the anode or cathode, for at least one hollow body with the opening pointing downward, at least one nozzle, which can move axially in relation to the hollow body as far as the opening, for a water-soluble surface coating agent which produces the connection to a cathode or anode, as electrolyte, an electrically insulating seal, which is in contact with the opening in the hollow body, for the nozzle, and at least one return flow passage which extends through the seal in the region between the nozzle and the internal edge of the opening in the hollow body.

The nozzle only needs to be moved as far as the opening of the hollow body and, with its electrically insulating seal, is in contact with the opening in the hollow body. The water-soluble surface coating agent is sprayed centrally into the hollow body through the nozzle, flows as far as the base of the hollow body and then down the walls and passes out of the hollow body through the return flow passages. Owing to the mount, which is connected to a direct voltage source, the hollow body forms the anode or cathode while the water-soluble surface coating agent is connected, as liquid electrolyte, to the cathode or anode. In this way, an uninterrupted stream of liquid electrolyte can be conducted through the hollow body and within a short time a high-quality coating can be applied to the internal surface of the hollow body, the stream of surface coating agent flowing off through the return flow passages. Of course, the movement can also take place in the opposite way, i.e. the nozzle is fixed and the hollow body is moved with its opening toward the nozzle.

The mount for the hollow bodies can comprise a conveyor belt which extends horizontally above a collection trough and has gripping devices, for example suckers, for the bases of a plurality of packaging cans, or, if the packaging cans are made of sheet steel, the mount can be constructed as a magnetizable conveyor belt, which is led horizontally above a collection trough, for magnetically securing the bases of a plurality of packaging cans.

Underneath the conveyor belt, a plurality of nozzles may be arranged on a raising and lowering device, the hollow bodies being transported in a clocked fashion into the region of the nozzles by means of the conveyor belt. The which nozzles are raised at the moment when the conveyor belt is stationary and the electrically insulating seals are brought into contact with the openings of the hollow bodies. After this, the water-soluble surface coating agent is sprayed through the nozzles into the interior of the hollow bodies by means of pumps and flows back through the return flow passages, for example into a collection trough arranged underneath the containers.

Preferably, each nozzle can have a carrier pipe on which there is arranged a conical seal with a smaller diameter which can be inserted into the opening in the container and a larger diameter which exceeds the diameter of the opening, a plurality of return flow passages being arranged so as to start in the vicinity of the internal edge of the opening in the hollow body and to extend essentially vertically outside the carrier pipe.

These return flow pipes can, as already mentioned, end with clearance above a collection trough or be connected to a suction pump which ensures that the air located in the interior of the hollow body is sucked away, as a result of which the formation of foam is avoided.

Instead of moving the conveyor belt with the hollow bodies in a clocked fashion and displacing the nozzle into the region of the openings in the containers when the conveyor belt is stationary, it is also possible to move the conveyor belt or a corresponding transportation device continuously and to move the nozzles along with the containers. Furthermore, instead of a conveyor belt, it is also possible to use a turntable with an upper, rotatable plate on which there are mounts for the hollow bodies and a lower plate on which the nozzles are located. If the nozzle feed lines are provided with reversing valves, they can also be used to clean and rinse the hollow bodies.

BRIEF DESCRIPTION OF THE DRAWINGS

The invention is explained below in greater detail by means of an exemplary embodiment illustrated in the drawing, in which.

DESCRIPTION OF PREFERRED EMBODIMENTS

Figure 2:
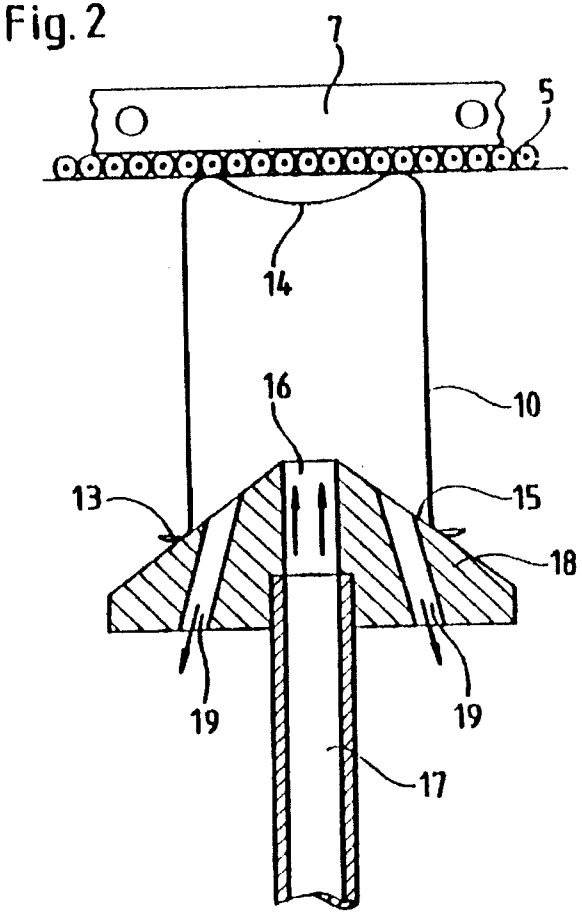
FIG. 2 shows a detailed view of a packaging can with a nozzle in the working position.

Only portions are shown of the coating region of an electrophoretic coating device which usually comprises a degreasing system upstream of the coating system and a surface coating agent drying system downstream of the coating system. A reservoir 2 of water-soluble surface coating agent is filled, as liquid electrolyte, into a collection trough 1. A direct voltage source 3 is connected to a plate 4, arranged in the collection trough 1, as cathode and to a conveyor belt 5, guided over a pair 6 of deflection rollers, as anode. Arranged above the lower strand of the conveyor belt 5 is a rail 7 which serves as a counterbearing.

Packaging cans 10 are moved onto the conveyor belt 5 by means of a conveyor belt 8 which is led over a pair 9 of deflection rollers. By means of a device (not illustrated), the packaging cans 10 are placed with their opening 15 pointing downward on the conveyor belt 8 and lifted off from the conveyor belt 5 when they arrive in the region of this conveyor belt 5. In the examples illustrated, the packaging cans 10 are made of sheet steel and are therefore ferromagnetic so that the transfer of the packaging cans 10 from the conveyor belt 8 onto the conveyor belt 5 can be effected by magnetizing the conveyor belt 5. This can be achieved by constructing the rail 7 as an electromagnet. As a result, the packaging cans 10 can be lifted off from the conveyor belt 8 and are suspended with their bases 14 on the conveyor belt 5.

The transportation of packaging cans 10 by means of the conveyor belt 8, the conveyor belt 5 and a conveyor belt 11, which is connected downstream and is led over a pair 12 of deflection rollers, takes place in a clocked fashion. Whenever the packaging cans 10 which are magnetically secured to the conveyor belt 5 by their bases 14 are stationary, nozzles 16 which have a conical seal 18 made of electrically insulating material and are connected to a raising and lowering device 22 by means of a yoke 21 are raised and pressed in a sealing fashion against flanged edges 13 of the packaging can 10. The conical seals 18 are attached to carrier pipes 17 and have a small diameter which projects into the openings 15 of the packaging cans 10 while the outer diameter of the conical seals 18 is greater than the diameter of a flanged edge 13 of the packaging cans 10.

After a plurality of packaging cans 10 has been sealed by means of a plurality of conical seals 18, pumps 20, which pump out water-soluble surface coating agent as electrolyte from the collection trough 1 and hoses 23 via the carrier pipes 17 and the nozzles 16 into the interior of the container. This jet of electrolyte rises out of the nozzles 16 until it strikes the arched base 14 of each drinks can. There it is deflected outward and flows down along the internal surface of the packaging can and through the return flow passages 19 directly into the collection trough 1.

Since the water-soluble surface coating agent sucked in by the pumps 20 is placed in contact with the cathode 4 while the packaging cans 10 are placed in contact with the anode, i.e. the conveyor belt 5, during the time that the water-soluble surface coating agent flows within the packaging cans 10 there is a balancing out of charge and thus an electrophoretic coating of the internal surface of the packaging cans 10 takes place without the external surface coming into contact with any particles of surface coating agent. Thus, on their external surface the packaging cans 10 remain completely untouched by the water-soluble surface coating agent located in the collection trough 1 so that no coating takes place at the external surface either.

Depending on the duration of the spraying of the interior of the packaging cans 10 and the applied voltage, a thickness of coating which can be adapted to the requirements is produced.

Figure 1:
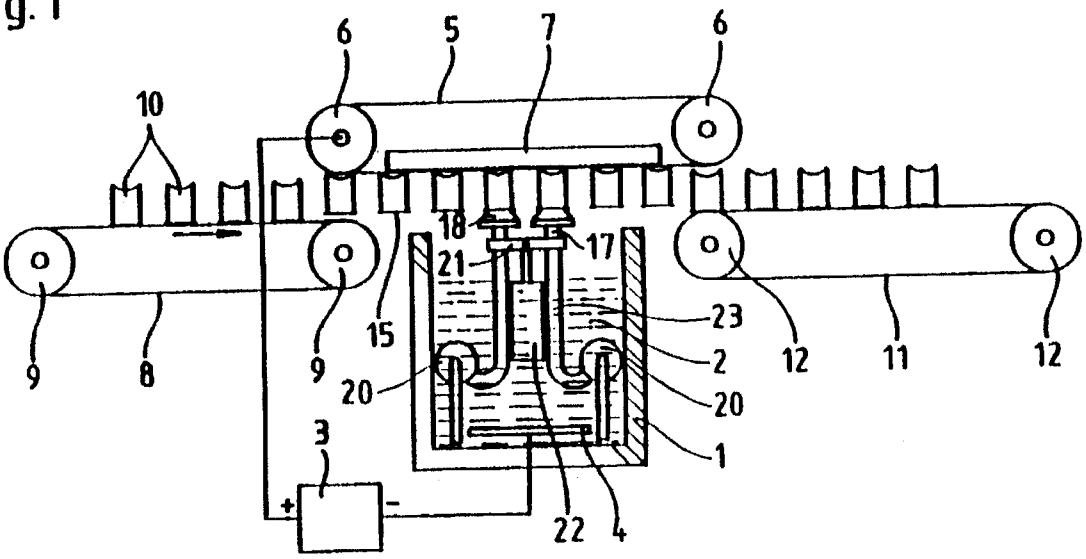
FIG. 1 shows a schematic view of the device according to the invention.

The exemplary embodiment described in FIGS. 1 and 2 shows a system for the electrophoretic coating, in which system the cathode 4 is arranged in the collection trough 1 while the conveyor belt 5 forms the anode. Of course, it is also possible to construct the plate 4 as anode and accordingly provide the conveyor belt 5 as cathode.

Furthermore, it is possible to connect the return flow passages 19 to suction pumps (not illustrated) which suck out both the air and the water-soluble surface coating agent from the packaging cans 10 and feed the said water-soluble surface coating agent back into the collection trough 1. This collection trough 1 is also advantageous in this embodiment since when the nozzles 16 with the conical seals 18 are lowered, residues of surface coating agent can always continue to drop off and these are advantageously collected in a collection trough 1 arranged below the nozzles 16.

It is also possible to move the conveyor belts 8, 5, 11 continuously instead of in a clocked fashion. In this case, it is however necessary for the nozzles 16 with the conical seals 18, the yoke 21 and the raising and lowering device 22 to be moved along with the packaging cans 10 while the water-soluble surface coating agent is sprayed into the interior of the drinks cans 10.

Since the external surface of the packaging cans does not come into contact with the surface coating agent, in packaging cans made of nonferrous metal, for example of aluminum, suckers can also be used as the gripping device. For this purpose, turntables which are arranged above a collection trough and have an upper plate, which has the gripping device, and a lower plate, which has the nozzles, can be used, said plates being turned in a clocked fashion and either the packaging cans being lowered onto the nozzles, or the nozzles being raised, in a clocked fashion.

Furthermore, it is possible to provide the feed lines to the nozzles with reversing valves so that the cleaning, coating and rinsing can be carried out successively by means of the nozzles.

It is advantageous in all cases that it is possible with little outlay to coat quickly and cleanly only the interior of a large number of packaging cans so that the external surface remains free of the water-soluble surface coating agent provided for coating the internal surface and the said external surface can be coated in some other way which is appropriate to requirements.

I claim:

1. A device for the electrophoretic coating of the internal surface of electrically conductive hollow bodies, each body having an opening into the body, the device comprising:

at least one mount for supporting at least one of the hollow bodies with the opening of the body pointing downward and the mount connectable to define one of an anode or cathode;

at least one nozzle; means supporting the nozzle for movement toward and away from the opening of the hollow body, the nozzle being for delivering therethrough a water soluble surface coating, and the nozzle being positioned and the coating being of such material that the coating serves as a liquid electrolyte which is connectable to define the other of the anode and cathode;

an electrically insulating seal movable into contact with the opening in the hollow body for sealing the hollow body, the nozzle passing through the seal to open into the hollow body;

a return flow passage extending through the seal, being separate from the nozzle and being in the part of the seal which is inside the opening of the hollow body for enabling return flow of the water soluble surface coating out of the hollow and through the seal.

2. The device of claim 1, wherein the mount for the hollow body comprises a conveyer belt; means for moving the conveyer belt horizontally;

the conveyer belt including means for gripping a plurality of the packing cans and holding them to the conveyer belt.

3. The device of claim 2, further comprising a collection trough for the surface coating disposed beneath the horizontal path of the conveyer belt.

4. The device of claim 2, wherein the conveyer belt is a magnetizable conveyer belt for magnetically supporting the hollow bodies, comprised of steel, to the conveyer belt.

5. The device of claim 2, wherein there are a plurality of the nozzles; a nozzle raising and lowering device for the plurality of nozzles and disposed beneath the conveyer belt.

6. The device of claim 5, wherein each of the nozzles includes a carrier pipe for carrying the coating to and through the nozzle;

the electrically insulating seal being a conically shaped seal including a tapering shape surface which is inserted into the opening in the hollow body, and the seal having a larger diameter exceeding the diameter of the opening;

a plurality of return flow passages through the seal, starting in the vicinity of the internal edge of the opening in the hollow body and extending through the seal outside the carrier pipe.

7. The device of claim 1, wherein each of the nozzles includes a carrier pipe for carrying the coating to and through the nozzle;

the electrically insulating seal being a conically shaped seal including a tapering shape surface which is inserted into the opening in the hollow body, and the seal having a larger diameter exceeding the diameter of the opening;

a plurality of return flow passages through the seal, starting in the vicinity of the internal edge of the opening in the hollow body and extending through the seal outside the carrier pipe.

8. The device of claim 6, further comprising a collection trough for the surface coating disposed beneath the horizontal path of the conveyer belt limits;

the return flow passages of the seal being so positioned that with the seal in the opening in the hollow body, the return flow passages end with clearance above the coating in the collection trough.

9. The device of claim 1, further comprising a suction pump connected with the return flow passages for drawing the coating out of the hollow body through the return flow passages.

10. The device of claim 1, further comprising a plurality of the mounts for the hollow bodies; a raising and lowering device for the mounts disposed above the nozzles for moving the mounts with reference to the nozzles.

11. The device of claim 7, further comprising a reversing valve for supplying the hollow body with cleaning fluid, with surface coating agent, and with rinsing fluid connected into the carrier pipe leading to the nozzle.

12. The device of claim 1, further comprising a reversing valve for supplying the hollow body with cleaning fluid, with surface coating agent, and with rinsing fluid connected into the carrier pipe leading to the nozzle.

13. The device of claim 1, further comprising a supply of a water soluble surface coating; and the nozzle communicating into the supply.

* * * * *